United States Patent [19]

Laborde

[11] Patent Number: 4,588,192

[45] Date of Patent: May 13, 1986

[54] FINANCIAL FUTURES GAME

[76] Inventor: Pedro Laborde, P.O. Box 21718, UPR, Rio Piedras, P.R. 00931

[21] Appl. No.: 532,381

[22] Filed: Sep. 15, 1983

[51] Int. Cl.[4] ..... A63F 3/00

[52] U.S. Cl. ..... 273/240; 273/278; 273/287

[58] Field of Search ..... 273/278, 256, 287, 284; 434/107, 347

[56] References Cited

U.S. PATENT DOCUMENTS

| | | | |
|---|---|---|---|
| 2,176,258 | 10/1939 | Griffith | 273/278 X |
| 2,299,284 | 10/1942 | Steidemann | 273/278 X |
| 2,800,330 | 7/1957 | Pickard | 273/284 X |
| 3,235,977 | 2/1966 | Tusson | 434/107 X |
| 3,254,894 | 6/1966 | Kollmeyer et al. | 273/278 |
| 3,528,663 | 9/1970 | Curtz et al. | 273/278 |
| 3,865,380 | 2/1975 | Thomas | 273/256 |
| 4,378,942 | 4/1983 | Isaac | 273/278 |

*Primary Examiner*—Richard C. Pinkham
*Assistant Examiner*—Matthew L. Schneider
*Attorney, Agent, or Firm*—Wegner & Bretschneider

[57] ABSTRACT

A game which simulates the trading of financial futures and its applications. The game apparatus includes a chart which provides the necessary market information for given instruments for a 20-day playing period, plus the preceding five days, with only a portion of the chart visible to the players on any given playing day. The game apparatus also includes a holder with a display window and a pair of rollers to which the ends of the chart are affixed. The chart moves past the window when one of the rollers is turned. The window is of a size that the full chart, covering the 20 day playing period and the preceding five days, will appear in it on the last playing day.

8 Claims, 16 Drawing Figures

Traders

Original Portfolio

A. Assets.

1. T-Bonds

Face value each . . . . . $ 100,000

Current B. D. ≠ 1 price . . . . . .

Number . . . . . 3 a. Total value . . . . . .

2. Cash.

a. Value ( $ 3M- 1(a.)). . . . . .

3. Total assets . . . . . $ 3M

B. Liability.

1. Order to emit a hedged 90D-CD for $ 1M during the first eight days of the game.

Current B. D. ≠ 1, C. D. rate . . . . . .

C. Net Worth . . . . . $ 3M

FIG. 6

Portfolio
Net Worth

B.D. #____

A. Assets

I. Bonds Number _____ Current Price _____ Current $ Value _____

II. CD's purchased on emission.

1. Face value plus interest to accrue. Days(____) _____

2. Face value plus interest to accrue. Days(____) _____ a. Total _____

III. Cash

1. Preceding B. D. Portfolio Cash _____ _____

2. Business day operations:

| | + | − |
|---|---|---|
| a. Futures legs outcome in hedging Gain (+) Loss (−) | | |
| 1. | | |
| aa. Prize | | |
| b. Futures legs outcome in spreading | | |
| c. Futures leg outcome in pure speculation | | |
| d. Bonds Sale (+), Purchase (−) | | |
| e. CD emission. Sale (+) | | |
| f. CD emission. Purchase (−) | | |
| g. Credit extended to other traders (−), received (+) | | |
| h. Totals | | |
| i. Net Cash | | |

IV. Credit Extended _____

V. Total asset . . . I+II(a)+III(1)+III(2,i)+IV _____

B. Liabilities a. Credit received _____ b. CD emitted. − Face value + interest

1. Total _____

C. Net Worth . . . . A (V)−B(1) _____

FIG. 7

T-Bond

Principal: $ 100,000 Coupon Rate: 13% Long Mat.

Trading price ____ , ____ , ____ -

FIG. 8

Emission Date: B. D. # _____

90D - Certificate of Deposit

Face Amount: $ 1,000,000 Yield Rate: _____

FIG. 9

B.D. # _____

Cash Disbursement

To Trader # _____

By Trader# _____

For _____ $ _____

FIG. 10A

B.D. # _____

Receipt of Cash Payment

By Trader # _____

From Trader # _____

For _____ $ _____

FIG. 10B

Hedge Operation

| Cash Market | | Futures Market | |
|---|---|---|---|
| Open | Price/rate _____ | Open | Price _____ |
| Close | Price/rate _____ | Close | Price _____ |

Cash Gain/Loss _____ Futures Gain/Loss _____ Net: _____

FIG. 11

B. D.# _____

Spreading or Pure

Speculation* Futures

Legs

| Nearby | | Deferred | |
|---|---|---|---|
| Open | Price _____ | Open | Price _____ |
| Close | Price _____ | Close | Price _____ |

*Fill only corresponding leg.

Nearby Gain/Loss _____ Deferred Gain/Loss _____ Net _____

FIG. 12

B.D.#___

Credit Slip

Extended to Trader# _____

$ _____

FIG. 13A

B. D. # ___

Credit Slip

Received for Trader # _____

$ _____

FIG. 13B

B. D.#_____

Prize Slip

For

Perfect Or Overhedge

S 1000.00

B.D. filled by winning Trade

FIG. 14

FINANCIAL FUTURES GAME

BACKGROUND OF THE INVENTION

This invention relates to a game, and more particularly, this invention relates to a game which simulates the trading of financial futures and its applications.

There are many games which involve principles of stock market trading, but most of these prior art games are based primarily on chance with little exercise of the player's skill and with little relation to actual market forces. For instance, the game described in U.S. Pat. No. 2,088,137 to McAbee involves the use of a chart with a number of columns intersected by rows with each square defined by the columns or rows specifying some occurrence dictating what a player must do when "landing" on the particular square by an element of chance denoted by the spinning of a pointer, or the like.

U.S. Pat. No. 3,163,423 to Jackson involves a board game with a layout quite similar to other typical board games, with squares around the periphery of the board and a number of stacks of instruction cards placed in the center of the board. Players move their tokens around the board according to the throw of dice and then follow the instructions printed on the squares in which they land.

U.S. Pat. No. 3,237,948 to Murray teaches a board game where moves of the players are dictated by cards chosen at random.

Similarly, U.S. Pat. No. 3,770,277 to Cass involves a game where the players' moves are dictated by the throw of dice.

Other prior art games such as those disclosed in Lefevre et al Pat. Nos. 3,799,552 and Barnett 4,150,827 also provide boards of various configurations and are based on principles of chance whereby the moves made by the players are dictated by some arbitrary means such as the throw of dice, the spinning of a wheel, or the like.

Furthermore, all of these prior art games involve the concepts used in trading on stock markets, which concepts are fairly well known and easily understood. The players of these games are assumed to already have a familiarity with these concepts. There are no games, however, based on financial futures markets, markets which are comparatively new in the United States. The principles involved in trading on futures markets are more complex than those commonly understood to be involved in trading on stock markets. Thus, in order to fully understand the instant game, some background in the working of the financial futures markets is necessary.

INTRODUCTION

Operations in futures are based on trading, selling and buying, fixed return financial instruments contracts in the futures markets. Recourse by the cash market usuaries to the corresponding futures market is done with the purpose of "hedging," or protecting cash market operations from risk due to volatile rates and prices of today's markets, so as to cancel risk losses as much as possible. However, with the aid of the futures markets, one may also perform other operations such as pure speculation, spreading operations, arbitrage, and buying and selling for delivery. The last of these, delivery, is the basic operation from which all futures operations are made possible.

Futures delivery of financial instruments is at the basis of the futures markets operations, and may be considered as an adaptation of the long known futures operations (delivery in the future) in commodities. However, we cannot say that delivery itself is the main operation in financial futures, since most contracts are offset by the opposite trade before the time for delivery is announced. Offsetting one's opening position is necessary for the other futures operations mentioned before with the exception of pure delivery arbitrage.

Of those futures operations in which offsetting is practiced, the game of the present invention deals with all, except offset arbitrage. Thus, this in this game, the main futures operations performed are:

1. Hedging
2. Spreading (Intra)
3. Pure Speculation

These are explained further on in detail. The instruments to be traded in the game are limited to Treasury Bonds (T-Bonds) and 90-day Certificates of Deposit (90D-CD's), and their corresponding contracts in the futures markets.

The only instance in which the player may do cash trades without hedging (pure speculation in futures and spreading do not involve a trade in the cash market) in the game is when he answers an offer to sell or a bid to buy a cash instrument at current price from a hedger who is offsetting a hedging operation, and in which no trader in the game had taken in advance the complete (cash and futures) counter trades of the hedger.

Prompted by conditions of an econometric nature, by supply and demand considerations, by federal spending and control of certain economic indicators, by the reasoning of traders and investors, by seasonal and otherwise practices of consumption and saving, etc., the prices and rates of financial instruments currently suffer abrupt changes and thus bring along the financial risks in the markets. This volatility of prices and rates has been a major factor in the onset of the financial futures markets and the hedging operation. Investors and others who must face these risks have found in hedging a means to protect their cash financial operations by, instead of facing the straight market risk, facing the transform of the same into what futures hedging scientists call basis risk, and the spreaders denote as spread risk. Basis risk is a more bearable risk than market risk. Futures scientists explain in their theoretical works and practices how we may protect in turn from basis risk, whenever it is possible, so as to try and reduce in turn the effects of basis risk. The spreaders, on the other side, profit by forecasting enhanced spread changes and trade according to spreading theory so that these changes turn out in their benefit.

The game players need not get involved with any theoretical intricacies such as those which appeal the futures scientists, for they will become aware of the nature of hedging, as well as spreading and pure speculation, through simplified procedures.

CONSIDERATIONS REGARDING THE FINANCIAL FUTURES MARKETS

In the financial futures markets, there are traded futures contracts which specify the qualities of the underlying cash instruments that are to be delivered through them in a certain future month. When one sells (a "sell" position is known as a "short" position to traders, a "buy" position is known as a "long" position to traders), a Treasury Bond contract (T-Bond Contract) for delivery in a certain future month, and on the date that the exchange prescribes, he commits himself not only to deliver the instrument according to the specifications described in the contract, but also to comply with all other Clearing House (the exchange's Clearing House regulates the operations at the exchange) regulations on the same. One of the important specifications is the compliance with the dates announced by the Clearing House during the month of delivery. The trader must also comply with a performance bond, known as a margin deposit since contracts are traded daily at the exchange and prices and rates suffer constant changes. The Clearing House carries on the "daily marking up to market": computes daily, on closing trading business, any gains or losses accrued by the trader's original position. If at the day closing time the contract which is sold experienced a decrease in price, then the trader accrues a gain from this decrease in price. The gain is paid by check. However, if the prices went up and hence a loss is registered, this is deducted from the margin deposit. In case the balance in the margin account goes below a certain level (margin level), the Clearing House asks the trader to replenish the original margin deposit.

Normally a broker takes care of the trades in futures through his traders at the exchange. A fee is paid to the broker for attending to the trades on a contract and other services. Margin deposits may vary according to the contract being traded.

In case the original position was a purchase, or long position, procedures follow in a similar manner to a sale, but in this case the trader is bound to receive delivery of the instrument bought through the contract at the specified contract month.

When a trader announces that he is selling a contract and succeeds, he comes in relation with another trader who buys the contract. They accord price within daily price limits and their trades pass to the records of the exchange. Thus, to every contract trade position, there is also a counter trade position performed simultaneously.

When a trader offsets his standing open position in futures, it is meant that he performs the counter-trade to the original one. If he sold on opening his position, he buys on offsetting the position, and vice versa.

Upon offsetting the trader computes a gain or loss according to the price movement in the contract during the life of his position. Offsetting is basic to speculation, hedging, spreading, and offset arbitrage. The trader who offsets his opening position, cancels his obligation of making or taking delivery.

Settlement prices are prices accorded to the contracts by the Clearing House at the end of the business day. If there is a last price at which a last trade was performed, this closing price is defined as the settlement price for that day. If instead there is a range of last minute trades, the Clearing House defines a settlement price in relation to this corresponding range of prices. Settlement prices are used for marking up to market the open positions and other purposes. At the outset of a business day the exchange announces the "daily price limits," which are price bounds above or below the previous day settlement price, and within this bounded range the prices during the business day trading must abide. In case certain conditions of the market regarding prices present obstacles to expected trading, then the exchange enacts "variable limits," this is a widened price range. Variable limits call also for variable margin.

The delivery months in most exchanges are March, June, September, and December. Thus, one may go "short" or "long" in a March Bond contract or a September Treasury Bill contract, etc.

The above description of facts and usages in the financial futures markets will be followed in this game, but on occasion these are modified, and some may be omitted.

PRICING THE FINANCIAL FIXED INCOME INSTRUMENTS AND THEIR FUTURES CONTRACTS

Before one actually enters into trading operations, he must consider the methods for pricing the debt instruments and their contracts on which he shall deal. Related to each debt instrument there is an acknowledgment of debt, a life or maturity, and a rate of return. Since in the game the player trades T-Bonds and issues Certificates of Deposit in the cash market, and trades the corresponding contracts in the futures markets, this description will be limited to these two debit instruments.

1. T-Bonds (Treasury Bonds)

T-Bonds bear a principal value, rate (coupon rate), and maturity. The rate is an annualized rate expressed as a percentage. The corresponding rate percentage of the face value is the fixed yearly profit that the holder (owner) of the instrument receives in semester installments. Maturity, or life of the Bond, is the time interval during which the rate is active. At the termination of the maturity period the bearer receives principal and last interest semi-annual payment, and the Bond is returned to the issuer. For example:

| T-Bond | | |
|---|---|---|
| Principal: $100,000 | Rate: 11% | Maturity: 20 Years |

T-Bonds are negotiated in the primary and secondary markets. The primary market is concerned with the issuer, Bond dealer and initial investor; the secondary market deals with trading the original issue. Both markets affect one another in their operations, as well as the corresponding futures markets.

The price of a Bond is expressed as a percentage of principal, or par value (100%). Yield is the percentage of price value at which the Bond produces its fixed rate of return defined by principal and coupon rate.

In general, there are various fixed income financial debt instruments which are extensively used in the financial community. The main common characteristics of these instruments are that each is a certification of debt to the possessor of the instrument on the part of the debtor, that the debtor must pay for the use of the debt amount according to the percentage rate for the debt, the interest rate. The debt is active for an agreed lapse of time known as the life of the instrument, at the end of which the instrument matures and debt agreement is terminated.

As already mentioned, the current value of a financial instrument is its price and the cost of the debt is its interest rate. Price volatility increases with maturity, whereas yield volatility decreases with maturity. That is, long maturities are affected by greater changes in price than shorter maturities for a given constant change in yield, taking instrument and debt amount constant. Short maturities are affected by greater yield changes than longer maturities for a given constant change in price, taking instrument and debt amount constant.

Due to the high volatility in short maturity yields and long maturity prices experienced in the present cash markets, the financial futures markets were introduced in 1975 so as to offer a means of protection against volatility in general through the hedging operations in financial futures.

Some of the popular financial interest rate instruments are Bonds (including T-Bonds), GNMA's (Mortgage pools), Commercial Paper, T-Bills, T-Notes, and Certificates of Deposit. Treasury issues are used by the Federal Government as a means to fill in budgetary needs. Of these, T-Bonds and T-Bills are very important. In particular T-Bills are much used by the Federal Reserve Bank as a means for enacting fiscal policies aimed at promoting good financial conditions.

If the T-Bond mentioned above were sold in the secondary market at an 11% yield, then its price would be 100% of its principal value, or par value. However, if it were sold at a yield of 12%, its price would be lower than 100% of its principal value, $91\frac{2}{3}$%. This is so since there is a fixed annual return of 11% of par value, and for higher trading yield the price must be lower than at par so that there is obtained the fixed annual return defined for the Bond (0.11)($100,000)=$11,000. In our case, $11,000/0.12≅$91,666.

Similarly, if the market yield goes under the yield at par (coupon rate), then the price goes over the price at par (100%).

Prices over par (100%) are denoted as premium prices, and those below par as discount prices.

When prices of Bonds (and other coupon instruments) are not representable as an integral percent, for example: $91\frac{1}{4}$%, $89\frac{1}{2}$%, etc.; that is, when these bear a fractional part of 1%, we represent the fractional part as the nearest thirty second of 1% and adopt the following symbol. If the price were $89\frac{1}{2}$%, we have:

$89\frac{1}{2}=89-16$ $91\frac{3}{4}=91-24$ 90 1/16%=90−02

In the symbol displayed on the right, the integer following the dash represents the number of 32nd's of 1% which make up the fractional percentage on the left.

If the price of the T-Bond described above were 85−10 at some moment in the market, the $ value of the Bond at that price is:

(85−10) ($100,000)=(85 5/16%) ($100,000)=$85,312.50

2. T-Bond Futures Contracts

In the T-Bond futures markets, the instruments traded are T-Bond futures contracts written on cash T-Bonds. These contracts may be sold (short position) or bought (long position). When a T-Bond contract is sold for a certain delivery month (March, June, September or December), the seller accepts the obligation to deliver a cash T-Bond on delivery day and as described in the contract.

The sale of the contract is accorded by the futures trader in the corresponding futures market with another trader who buys the T-Bond futures contract at an agreed price within the price limits for the day. The particular T-Bond, however, does not necessarily go to the buyer represented by the buying trader since it may be delivered to any other T-Bond contract buyer who is taking the same delivery. And, furthermore, the seller may not actually deliver the T-Bond if he offsets his initial short position by a long one. Similarly, for an initial position in which the T-Bond contract is bought (long), however, the initial long position conveys the obligation to accept delivery, etc.

Deliveries of cash T-Bonds made through the T-Bonds contract are for $100,000 principal value, 8% coupon rate, and are retainable for at least fifteen years.

T-Bond futures contracts are priced in the same manner as their cash underlying instrument. The minimal fluctuation in price accepted is 1/32% (written as 00-01). This corresponds to a dollar value change of $31.25. (1/32%)×$100,000=$31.25.

3. Domestic CD's

Cash Domestic Certificates of Deposit are usually issued on an add-on yield basis. Some banks do it on a discount basis. The CD instrument bears a face value, maturity period, and yield. These have a life up to one and a half years, thus they represent short term debt. CD's written out to the bearer, negotiable certificates, for a minimum of $100,000 are tradeable in the secondary market. When the instrument matures, the interest dollar payment is computed according to face value, maturity period and yield rate. Face value plus interest payment is handed over to the bearer as maturity value Interest Payment=Face Value×Rate×Life in Days÷360.

Example: A CD is issued for $1,000,000 at a 12% yield for 180 days (maturity period). The interest dollar return upon maturity is:

Interest Payment=$1,000,000×0.12×180÷360=$60,000

Maturity value=$1,000,000+$60,00=$1,060,000

In relation to cash CD markets there are CD contracts futures markets in which one may carry on hedging operations to cash CD operations, among others. In the game spreading operations and pure speculation may be enacted with CD contracts.

4. CD Futures Contracts

The CD futures markets operations are related to cash CDs in a similar manner as are T-Bond contracts and the cash T-Bond. The CD futures contract entered the futures markets in 1981.

Through the Domestic CD contract, deliveries of cash CD's are made in value of $1,000,000 and three months maturity. The contracts are priced on a Price Index (100-Rate). The minimum price change ("tick" - in the market) is for one basis point (0.01%), which amounts to $25.00 for each contract.

0.01%×$1,000,000×3/12=$25.00

Example: One CD June contract is sold (short position) on April 1 at a price index of 86.10 (Rate 13.90). A week later rates have gone up (and price index down) and the opening position is offset by taking a long position in one CD contract at a price of 85.15. There is a gain from the falling price which amounts to:

Gain=(86.10−85.15)×$25/0.01=95×$25=$2375.

where the change in price is 95 basis points, each valued at $25.00. If the opening position had been long, upon offsetting with the short position, there would have been a loss in the same amount.

FUTURES MARKETS OPERATIONS

As already discussed, in the established futures markets, one may sell or buy (go short or long in) a futures contract. In order to perform this operation and see to its consequences in an efficient manner, many things are collaterally attended to. There is an administrative staff which sees to overall effectiveness of procedures, experienced personnel who carry on multiple tasks with precision. Neither shouting or other noises may hinder the open market activities and, above all, there are established regulations which must be followed by all. Also, as a trader pointed out, there must exist the speculator.

The speculator abhors delivery, he does not want to be delivered to, or to deliver, financial instruments. He enters into the trading of futures contracts which he never touches, all he wants is a gain credited to his account. The speculator always offsets his open positions. Trying to obtain a gain, and usually being a large investor in futures contracts, he may lose or gain large amounts.

Of all the operations carried on in the futures markets, delivery and pure speculation occupy outstanding positions. These two operations go to the very existence of the futures markets for interest rate instruments. Delivery is the point of departure which makes possible all other operations; speculation is that operation which provides liquidity to the markets. Hedging and spreading are the most important applications and arbitrage is a side product.

Futures markets coupon instruments contracts, as T-Bond contracts, are traded according to their statutory price; however, the CD futures are traded on a price index. In the game, the players deal on the T-Bond and CD instrument and their futures contracts, primarily for simplification purposes, as well as because these are very important fixed return financial instruments. T-Bonds represent long maturity issues and CD's short maturities. The game's Bonds will be affected by price volatility and the game's CD's by yield volatility.

The exchange Clearing House is the governing body of all exchange activities. As a matter of fact each purchase or sale of contracts is taken by the C.H. as the other side of the trade, thus guaranteeing full performance.

DELIVERY

This is the basic or fundamental operation in futures. Making or taking delivery is a consequence of going short or long and not offsetting.

Futures contracts vie with reference to a delivery month: March, June, September or December. In relation to these markets, market quotations prices are published daily for the preceding business day by several sources like the Wall Street Journal.

When one opens a delivery position in futures, one accepts all the Clearing House regulations contained in the contract, including to perform in delivery according to the established practices. For example, a 90D-T Bill of acceptable definition is delivered in case of a short position in the 90D-T Bill contract of the month involved. This is done according to directions of the Clearing House as to dates, acceptable quality, obligatory acceptance of delivery from the second party, etc., during the designated month of the year involved. The other party to the delivery, that is, a long party, likewise performs according to contract regulations in the acceptance of delivery.

HEDGING

Hedging in futures is a most important futures operation. It serves to protect our cash market operations from the inherent risk associated with them due to price or rate volatility. When one decides on a cash operation because on the current date (Date 1) the market price or rate is acceptable to him, he defines his financial market risk: be it that price or rate go up or down. He then enacts futures market operation the outcome of which will be a gain upon the materialization of his defined cash market risk or hedging risk.

On Date 1 he opens a position in the pertinent futures market by going short or long on a weighted amount of the futures contract. If his hedge risk is that cash prices go up, his opening position is a long (buy) one. On offsetting on Date 2, when he closes the cash operation by going short in the same contracts purchased on Date 1, and under a materialized hedge risk, a gain in futures is obtained from buying low and selling high. This gain annuls the loss incurred in the cash operation with a certain degree of efficiency.

However, when the hedge risk does not materialize, he gains in the cash market and loses in futures. He has in general:

a. 100% hedge efficiency (gain/loss) gain in one leg equal to loss in the other.

b. $<100\%$ hedge efficiency gain in one leg less than loss in the other.

c. $>100\%$ hedge efficiency gain in one leg greater loss in the other.

We refer to these (a., b., c.) as perfect, under, and over-hedges, respectively.

There is a very important property of financial instruments that we must always have in mind: as prices increase (decrease), the yield decreases (increases) for the instrument.

Sometimes it is the price change and others the yield change which is the important factor in determining the cash market risk.

In many occasions, for a hedge, it suffices to weight as to value on the contract which is traded in futures. By weighting as to value is meant trading in futures the same dollar value in contracts as the dollar value of the cash instrument. The ultimate aim from weighting is to obtain equal value changes from the instruments in the legs of the hedge (cash and futures) for the price or rate fluctuations in the legs. In certain occasions one must consider weighting for different relative changes of price or yield in the legs. If one's operation in the cash market is a future sale of $500,000 worth of long maturity T-Bonds, then since the futures contract to be traded is the T-Bond contract, and its underlying T-Bond has a $100,000 face value, he must trade (short) five contracts in order to weight for value. In case he were to issue in the future an amount of $2,000,000 in CD's for 90 days, then since the 90D-CD contracts are for $1,000,000 in face value for the underlying instrument, he must trade (short) two contracts. However, if he were to emit $2,000,000 in MMC's at some future date, then the number of 90D-CD contracts to be sold would be four 90D-CD contracts since MMC's are for 180 days.

A measure to hedge efficiency is obtained by comparison of the differences in prices between the cash and futures market, known as basis (price basis). Basis=-Cash price-Futures price. When basis on Date 1 and Date 2 are equal and for properly weighted (value) hedges, we have a perfect Hedge. That is, the loss in the cash market and the gain in the futures market (materialized hedge risk) will be equal. If basis fluctuates from Date 1 to Date 2, we may either have an overhedge (gain>loss) or an underhedge (gain<loss). When we hedge, straight cash market risk is substituted by basis risk. For a better understanding of these transactions, the following examples are given:

REFERENCE EXAMPLE 1

On Date 1 an investor decides to buy long maturity T-Bonds with a 10% Coupon rate for a total value of $400,000. He takes this decision because he finds the current price on Date 1 acceptable, and even though the price may increase (his risk) until the moment he actually buys on Date 2, he is confident that hedging will lock for him the acceptable Date 1 price. He is also aware that the price may move down but, in any event, he accepts Date 1 price.

The current T-Bond price on Date 1 is, say, 89-08, and the T-Bond contract price is, say, 89-24. His hedge risk is that the T-Bond price will increase between Date 1 and Date 2, hence he opens a long hedge buying four T-Bond contracts on Date 1. He takes such a position in futures because prices in the futures market move in correlation to those in the cash market (up-up, down-down), hence if his hedge risk (that prices go up in the cash market) materializes, prices will go up in the futures market contributing to a gain in futures from his original long position. This gain will compensate for the loss in the cash market. There are occasions when cash and futures market prices do not correlate, bringing possible serious problems to the hedge. However, this is not the norm. See P. Laborde, "On Net and Double Gains, or Losses, in Spreading Operations," *The Journal of Futures Markets,* Winter 1982.

The details and outcome of this hedge operation are given in the following hedge diagram.

| Long Cross[1] | | |
|---|---|---|
| | Bond Hedge | |
| Cash Market | Futures Market | Basis |
| Aug. 10<br>Decision to buy<br>$400,000 in 10% long maturity Bonds<br>Current price: 89-08 | Aug. 10<br>Investor buys 4<br>Sept. T-Bond contracts<br>Current price: 89-24 | −(0–16) |
| Sept. 2<br>Investor buys<br>$400,000 in 10% long maturity Bonds.<br>Current price: 91-16 | Sept. 2<br>Investor offsets his long position by selling 4 Sept. T-Bond contracts<br>Current price: 92-00 | −(0–16) |

Hedge outcome: Notice that basis on Dates 1 and 2 kept constant at −(0–16). Since the market went up (prices increased from Date 1 to Date 2), the hedged risk materialized and there is a gain in futures to compensate for the loss in the cash market operation. The results are:

| Cash loss | Futures gain |
|---|---|
| = [91-16-(89-08)] $400,000<br>= (91½ − 89¼) $400,000<br>= (.0225) $400,000<br>= $9000. | = [92-00-(89-24)]($31.25) 4<br><br>= 72/32 (31.25)4<br>= $9000. |

Net outcome = 0

-continued

| Long Cross[1] |
|---|
| Hedge efficiency $\left(\frac{\text{gain}}{\text{loss}}\right)$ = 100% |
| Type of outcome: perfect hedge<br>Cash price locked = 89-08 |

[1]Direct hedge - When the futures contract instrument is the cash instrument.
Cross hedge - When the futures contract instrument is not same cash instrument.

Hence, even though the market went up by 2¼ points, the fact that he had a perfect hedge means that the investor bought his bonds on Date 2 at the same cash price current on Date 1 which was acceptable to him.

REFERENCE EXAMPLE 2—A VARIATION OF REFERENCE EXAMPLE 1

Let us assume that price correlation between cash and futures price were not as perfect as in Reference Example 1, and that the futures contract price on Date 2 were 91-24. That is, basis fluctuates from -(0-16) on Date 1 to -(0-08) on Date 2.

| Hedge outcome | |
|---|---|
| Cash loss | Future gain |
| = $9000. | = [91-24-(89-24)]($31.25)4<br>= 64/32 (31.25)4<br>= $8000. |
| Net loss = $1,000. | |
| Hedge efficiency = $\frac{\$8000}{\$9000}$ 88 8/9% | |
| Type of outcome = underhedge<br>Cash price locked = 89-16 (since of the cash increase in price from Date 1 to Date 2 of 2-08, 2 points were cancelled by the futures gain). Notice that in an underhedge we end locking a price less acceptable than the Date 1 price; however, the resulting locked price is highly acceptable in this case. | |

In case these examples were in relation to a sale of bonds on Date 2, the hedge risk would be that market prices go down and the corresponding hedge would be a short hedge. (Sell futures on Date 1).

In a hedge it may happen that the hedge risk does not materialize. We would then gain in the cash market and lose in the futures market. This does not bring any difficulties at all with the exception that our cash operation be, for example, an emission of CD's, for in this case the losses in futures are due daily and the gains in the cash emissions are recovered when the CD's mature probably months ahead.

Let us try now the hedge of a CD emission. We purposely exemplify an overhedge.

REFERENCE EXAMPLE 3

Assume that on Date 1 the trader decides to emit at a later Date 2 a three months domestic certificate of deposit. The certificate's current rate is 13% on Date 1 and he forecasts a rise in rates. Hence his cash market risk or hedge risk is that CD rates rise, bringing a correlated down trend in futures CD contracts prices. Thus, his hedge is a short hedge. The hedge diagram is assumed to be as follows.

| Short Direct CD Emission Hedge | | |
|---|---|---|
| Cash Market | Futures Market | Rate Basis |
| Date 1 Decision to emit a 90-D domestic CD for $1,000,000. Current rate: 13% | Date 1 Banker sells a 90D-CD contract Current price: 86.00 Current rate: 14% | −(1.00) |
| Date 2 CD is emitted for $1,000,000 Current rate: 14% | Date 2 Banker buys a 90D-CD contract of same month as that sold on Date 1 Current price: 84.50 Current rate: 15.50% | −(1.50) |

Hedge outcome: There is a gain in futures from the down market price change of 150 basis points on the materialized hedge risk. Also, an increased emission cost of 1%.

| Cash increased Cost | Futures Gain |
|---|---|
| = (.01)($1M)¼ i.e., | = (150) ($25.) (1) |
| $= \text{(Rate Change)(Face Value)}\frac{90}{360}$ | = (Price Change)(Value per bp) (Number of Contracts) |
| = $2500. | = $3750 |

Net outcome = $1250 (gain)
Type of outcome = overhedge $$\text{Hedge efficiency} = \frac{3750}{2500} = 150\%$$

Cash rate locked = 12½%

The net gain means that he secured a better rate in emission than that current on Date 1. The net gain of $1250 corresponds to an improvement on the cash current rate on Date 1 of ½%. Thus, he locked a 12½% rate in the CD emission. Or in other words, the $3750 gain in futures adsorbs the $2500 loss in the cash emission which corresponds to the 1% increase in rate—plus 50% of the same rate increase or ½% with a cost of $1250.

We thus see that the overhedge permits emission of the CD at a lower rate than that current on Date 1.

SPREADING

Spreading in futures is an operation carried on with the aim of making a profit. The spreader engages in simultaneous operations in two different months on the same instrument contract, or on the same month on two different instrument contracts. The former is known as intra-spreading and the latter as Inter-spreading.

One opens with simultaneous opposite trades in the two markets, selling in one (short) and buying in the other (long), to be later offset by the corresponding counter trades.

The spreader is not interested in delivery, he just minds a well calculated net gain from both markets. This gives the spreading operation a high note as a speculative operation. However, in it there is a "hedging" ingredient from the two legs which offer a gain and a loss simultaneously under correlated moves in rates or prices. Spreading theory, which deals with the different occurrences in spreading, is somewhat complicated. Pure hedging itself, the quest for protection from risk to lock in Date 1 market prices or rates with as close an efficiency to 100% as possible, may be shown to be one of the transforms, or particular cases of the spreading operation.

The hedger may thus look sometimes at the hedging operation from the point of view of the spreader. He may try to obtain overhedges, something which has been denoted as trading the basis, spreading with the hedge, or non pure hedging.

The game uses intra-spreading with T-Bond or 90D-CD contracts. Spreading operations can be described in a general manner. At opening Date 1 the spreader takes positions in the corresponding futures markets according to his forecast on the change of the spread variate.

Price Spread Variate = Nearby futures price − Deferred futures price (for the moment we deal with price spreads, we may also consider rate spreads).

The nearby futures market is that one which delivers sooner of the two futures markets involved. The spreader takes his opening positions according to what his expectation, or forecast, for the spread change is. This is summarized in the following theorems from spreading theory in the case of constant signed spread expectations.

Onset positions for gains on price spreads are as follows:

| Spread Variate Expectation | Onset Trade |
|---|---|
| 1. To widen (absolute value) | Buy the higher and sell the lower priced contract |
| 2. To narrow (absolute value) | Buy the lower and sell the higher priced contract |

If the spread variate changes sign during the life of the spread operation, the position for gains at onset is that for a narrowing spread expectation.

These theorems are proved in spreading theory and hold for equal signed spreads at onset (Date 1) and offset (Date 2). If the spread expectation does not materialize on Date 2(Offset), then the spreader obtains a net loss, Gain in one leg-loss in the other leg $<0$.

The outcome of a spread is a net gain or loss provided respectively that the spread expectancy materializes or not at offset time (Date 2).

Net outcomes, as mentioned, between a gain in one leg and a loss in the other occur under correlated prices between two markets: however, we obtain double effects (double gains or losses) under uncorrelated markets between onset (Date 1) and offset (Date 2). In the game, the markets will be correlated as to prices and the players engage in price spreading in intra-Spreads.

(1) Spreading may be done based on rate spreads. Corresponding laws are obtained from the above theorems by interchanging rate and price and lower and higher.

(2) Changes in spread refer to absolute spreads.

When the game trader prepares to take onset positions in an intra-Spread, he proceeds according to the following steps:

1. He decides whether he will trade the T-Bond or CD contract. Once this is decided, his markets are the respective nearby and deferred.

The decision as to which contract is selected may be taken by looking at the historical (past business days) observations on the corresponding spread changes. It helps to remember that for a T-Bond a change of 1/32 is worth $31.25 per contract, whereas for a 90D-CD a change of one basis point is worth $25 per contract.

2. Take positions in both nearby and deferred futures markets for the contract selected in accord with the expected change, as directed by the theorems.

Experienced traders in real operations use various procedures to predict expected changes. Among these we find "charting" procedures and "fundamental analysis" in which exhaustive studies are made in relation to accepted factors related to such changes over extended period of time. The game traders will rely on limited data and hence the factor of chance will be present. After all, chartists and fundamental analysts not infrequently err in their purpose.

REFERENCE EXAMPLE 4

| T-Bond Intra-Spread<br>Expectation: Spread to Widen | | |
|---|---|---|
| June<br>Nearby Market | Sept.<br>Deferred Market | Price<br>Spread |
| Date 1<br>Spreader buys one T-Bond contract for June delivery<br>Current price 68-00 | Date 1<br>Spreader sells one T-Bond contract for Sept. delivery<br>Current price 67-16 | 00-16 |
| Date 2<br>Spreader offsets by selling a June delivery contract<br>Current price 69-00 | Date 2<br>Spreader offsets buying a Sept. delivery contract<br>Current price 68-05<br>00-27 | |
| Outcome | | |
| June leg<br>Gain: (32) ($31.25)<br>= $1000. | Sept. leg<br>Loss: (21) (31.25)<br>= $656.25 | |
| Net gain: $343.75<br>(or net gain: (11) ($31.25) = $343.75<br>where 11 is the change in spread). | | |

If the spread had narrowed from Date 1 to Date 2 under the correlated trends and constant signs experienced, the net result would have been a net loss. Furthermore, if either in the example or in this assumption the price trends had uncorrelated between Date 1 and Date 2 with constant signs, the outcomes would have been a double gain (gains in both legs) and a double loss, respectively.

ARBITRAGE

Arbitrage in futures is an operation enacted simultaneously in a cash and a futures market on a financial instrument and its corresponding futures contract so as to obtain an assured profit. Sometimes spreading operations are denominated arbitrages erroneously. In the spreading operation there is significant risk which may turn an expected profit to a loss. Not so in an arbitrage in which there is an assured gain.

Arbitrage in financial futures is categorized into pure arbitrage and quasi-arbitrage. In pure arbitrage one can forecast the amount of gain at onset Date 1. Suppose the cash market is at a discount to the futures market involved. One may buy on Date 1 the instrument in the cash market and simultaneously sell its contract in the futures market. He makes delivery in futures using the instrument bought in the cash market. Thus, he obtains a net profit at delivery time which can be calculated at onset Date 1 time.

A quasi-arbitrage operation may be enacted under the onset trades for a narrowing basis (convergence of prices on approaching delivery days) in a financial instrument and its cash and a corresponding futures market. On Date 1, he takes positions in both markets according to the theorems for spreading operations to produce a gain on a narrowing basis, upon offsetting both markets on approaching delivery days. Since then the basis has narrowed, he certainly makes a profit. However, the extent to which the basis narrows may not be predicted exactly and, thus, since the gain in such an operation is the dollar value of the change in basis for the number of contracts involved in weighting the operation, he may not calculate exactly this gain at onset time.

PURE SPECULATION

The pure speculation operation involves taking a short or long position in futures and offsetting at a later date with the expectation of accruing a profit from a down or an up market, respectively. Preparation for this operation involves very rigorous charting and fundamental analysis studies.

It may be said, considering the nature of the operations related to the interest rate financial futures markets, that the exchanges offer to us the possibility of enacting delivery one way or the other, and offsetting an open position, thus, pure speculation; however, on the basis of these, the traders and usuaries of these markets device such operations as hedging, spreading, and arbitrage.

SUMMARY OF THE INVENTION

It is, accordingly, a prime object of the present invention to provide a game which is both educational and recreational and accurately simulates the financial futures market.

It is another object of the present invention to provide a game which is both educational and recreational and utilizes a high degree of personal skill in the decision making process.

It is yet another object of the present invention to provide a game which is both educational and recreational and uses a simple playing apparatus.

It is a further object of the present invention to provide a game which is both educational and recreational and enables the players to pit their skill against each other with essentially the only element of chance being that dictated by market forces.

Consistent with the foregoing objects, a game is provided which comprises a chart display including data representing cash market prices, futures market prices, basis, and spread of both long- and short-term instruments, for a predetermined number of playing days plus a predetermined number of trading days prior to the start of the playing days. Twenty playing days and five trading days prior to the start of the playing days are preferred. The game further comprises means for displaying the current playing day plus all of the trading days and playing days prior to the current playing day, while obscuring all future playing days. The game also includes means for effecting an exchange of cash, which means could be play money or vouchers. Further, the game includes play Treasury Bonds having a given face value and coupon rate, play orders to emit a 90-day Certificate of Deposit for a given face amount at current rate in a given number of playing days, record forms for the hedging, spreading, and pure speculative operations, record forms for each player to record his portfolio net worth on a given day, and means for awarding prizes to players. The means for awarding prizes to players could be play money or a voucher for a fixed sum of money.

BRIEF DESCRIPTION OF THE DRAWINGS

This invention will be better understood and objects other than those set forth above will become apparent when consideration is given to the following detailed description thereof. Such description makes reference to the annexed drawings wherein:

FIG. 6 is a plan view of a trader's original portfolio form;

FIG. 7 is a plan view of a portfolio net worth form;

FIG. 8 is a plan view of a play Treasury Bond;

FIG. 9 is a plan view of a play order to emit a 90-day Certificate of Deposit;

FIG. 10A is a plan view of a cash disbursement voucher;

FIG. 10B is a plan view of a receipt for cash payment;

FIG. 11 is a plan view of a hedge operation record form;

FIG. 12 is a plan view of a spreading or pure speculations futures legs record form;

FIG. 13A is a plan view of a play credit slip for extension of credit;

FIG. 13B is a plan view of a play credit slip for receipt of credit; and

FIG. 14 is a plan view of a play prize slip for perfect or overhedge.

DESCRIPTION OF THE PREFERRED EMBODIMENT

Figure 1:
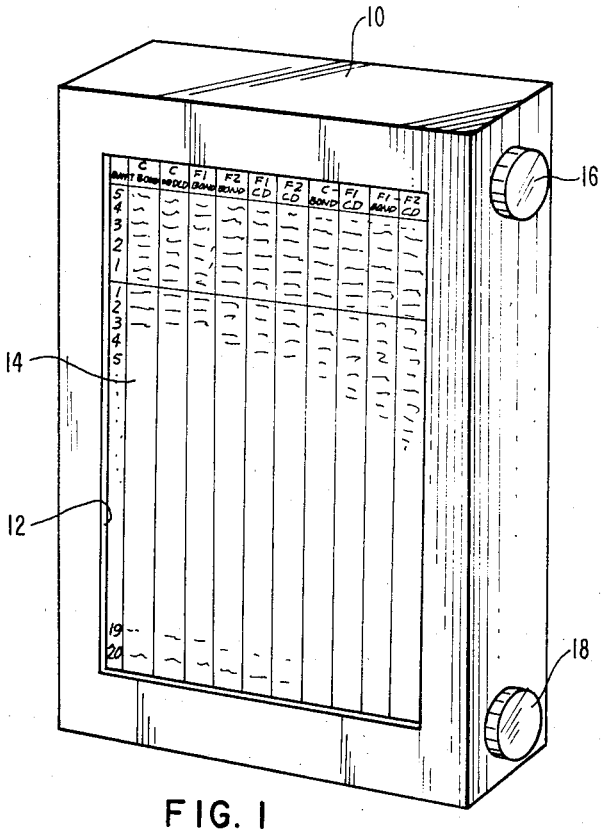
FIG. 1 is a perspective view of a holder with a display window and a chart display mounted for movement relative to the window, with the chart display showing 20 playing days and five preceding trading days but only a representative number of indicia being shown.
Figure 2:
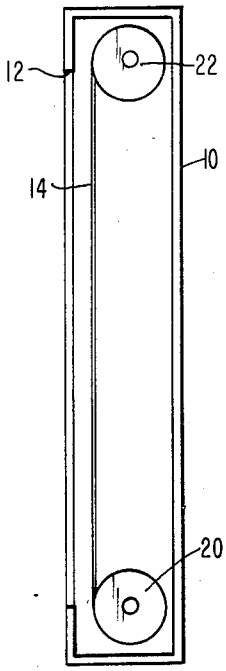
FIG. 2 is a side elevational view of the holder of FIG. 1 with the side wall removed to show the interior.

Referring first to FIG. 1, there is shown a holder 10 having a window 12 past which a chart display 14 moves. Chart display 14 can be moved in an upward direction or a downward direction by rotation of knob 16 or 18, respectively. As will be seen from FIG. 2, chart display 14 is wound around rollers 20 and 22 such that when one of the knobs 16 and 18 is turned the chart display moves either upwardly or downwardly past the window. It will be appreciated that an equivalent arrangement for providing relative movement between the chart and the window, such as one wherein the chart is stationary and the window opens and closes, could be used.

It will be seen that FIG. 1 depicts the device as it would be seen by the twentieth, or last, playing day of the game whereby all of the figures for all of the playing days and the preceding five trading days are displayed. The complete chart display appears in the following table:

| | | PRICE-RATE-BASIS-SPREAD | | | | | | | | | |
|---|---|---|---|---|---|---|---|---|---|---|---|
| | | CASH MARKETS | | FUTURES MARKETS | | | | BASIS | | SPREADS | |
| | | C | C | | | | | C-F1 | | F1-F2 | |
| | DAY | LONGMAT T-BOND | 90D CD | F1 BOND | F2 BOND | F1 CD | F2 CD | BOND | CD | BOND | CD |
| ANTERIOR | 5. | 93-00 | 17.40 | 58-16 | 58-28 | 82.10 | 82.50 | 34-16 | 0.50 | (−) 00-12 | −0.40 |
| | 4. | 92-24 | 17.40 | 58-00 | 58-18 | 82.10 | 82.54 | 34-24 | 0.50 | (−) 00-18 | −0.44 |
| | 3. | 94-08 | 17.20 | 58-20 | 59-04 | 82.35 | 82.71 | 35-20 | 0.45 | (−) 00-16 | −0.36 |
| | 2. | 94-21 | 17.10 | 59-08 | 59-24 | 82.65 | 82.95 | 35-13 | 0.25 | (−) 00-16 | −0.30 |
| | 1. | 95-24 | 16.80 | 60-06 | 60-23 | 83.10 | 83.28 | 35-18 | 0.10 | (−) 00-17 | −0.18 |
| TRADE | 1. | 95-23 | 16.60 | 59-18 | 60-00 | 83.30 | 83.50 | 36-05 | 0.10 | (−) 00-14 | −0.20 |
| | 2. | 96-07 | 16.40 | 59-28 | 60-09 | 83.52 | 83.62 | 36-11 | 0.08 | (−) 00-13 | −0.10 |
| | 3. | 96-08 | 16.50 | 59-26 | 60-08 | 83.43 | 83.55 | 36-14 | 0.07 | (−) 00-14 | −0.12 |
| | 4. | 97-08 | 16.25 | 60-19 | 61-00 | 83.70 | 83.80 | 36-21 | 0.05 | (−) 00-13 | −0.10 |
| | 5. | 97-24 | 16.20 | 60-24 | 61-06 | 83.78 | 83.91 | 37-00 | 0.02 | (−) 00-14 | −0.13 |
| | 6. | 98-16 | 15.85 | 61-09 | 61-23 | 84.20 | 84.26 | 37.07 | 0.05 | (−) 00-14 | −0.06 |
| | 7 | 96-16 | 16.08 | 60-02 | 61-20 | 83.90 | 84.10 | 36-14 | 0.02 | (−) 1-18 | −0.20 |
| | 8 | 95-00 | 15.95 | 59-05 | 59-20 | 84.00 | 84.21 | 35-27 | 0.05 | (−) 00-15 | −0.21 |
| | 9 | 94-00 | 16.20 | 58-20 | 59-05 | 83.65 | 83.97 | 35-12 | 0.15 | (−) 00-17 | −0.32 |
| | 10 | 92-07 | 16.60 | 56-28 | 57-12 | 83.22 | 83.50 | 35-11 | 0.18 | (−) 00-16 | −0.28 |
| | 11 | 92-17 | 16.65 | 57-13 | 57-29 | 83.15 | 83.42 | 35-04 | 0.20 | (−) 00-16 | −0.27 |
| | 12 | 91-04 | 16.80 | 56-13 | 56-29 | 82.95 | 83.25 | 34-23 | 0.25 | (−) 00-16 | −0.30 |

-continued

| | PRICE-RATE-BASIS-SPREAD | | | | | | | | | |
|---|---|---|---|---|---|---|---|---|---|---|
| | CASH MARKETS | | FUTURES MARKETS | | | | BASIS | | SPREADS | |
| | C LONGMAT | C 90D | F1 | F2 | F1 | F2 | C-F1 | | F1-F2 | |
| DAY | T-BOND | CD | BOND | BOND | CD | CD | BOND | CD | BOND | CD |
| 13 | 91-16 | 17.00 | 56-19 | 57-04 | 82.70 | 83.02 | 34-29 | 0.30 | 00-17 (−) | −0.32 |
| 14 | 91-24 | 16.90 | 56-24 | 57-08 | 82.70 | 82.96 | 35-00 | 0.40 | 00-16 (−) | −0.26 |
| 15 | 94.00 | 16.45 | 58-09 | 58-00 | 83.10 | 83.43 | 35-23 | 0.45 | 00-09 (−) | −0.33 |
| 16 | 95-00 | 15.75 | 58-17 | 59-00 | 83.85 | 84.03 | 36-15 | 0.40 | 00-15 (−) | −0.18 |
| 17 | 95-04 | 15.50 | 58-23 | 59-05 | 84.08 | 84.26 | 36-13 | 0.42 | 00-14 (−) | −0.18 |
| 18 | 95-17 | 15.30 | 59.03 | 59-17 | 84.25 | 84.62 | 36-14 | 0.45 | 00-14 (−) | −0.37 |
| 19 | 96-04 | 15.15 | 59-08 | 59-20 | 84.38 | 84.58 | 36-28 | 0.47 | 00-12 (−) | −0.20 |
| 20 | 97-08 | 14.70 | 60-00 | 60-14 | 84.85 | 85.06 | 37-08 | 0.45 | 00-14 | −0.21 |

Referring to the table, it will be seen that the chart display is divided into a plurality of columns. The first column denotes the day, wherein the first playing day is designated as trading day 1 and the last playing day is designated as trading day 20. The five preceding days are designated anterior days 1 through 5. The next two columns designate the price in the cash market, for each day, of long maturity Treasury Bonds and 90-day Certificates of Deposit, respectively. The next four columns represent the price, for each day, of bond and Certificate of Deposit futures. These four columns are for the futures price for nearby delivery month bond contracts; the futures price for first deferred delivery month bond contracts; the futures index for nearby delivery month Certificate of Deposit contracts; and the futures index for first deferred delivery month Certificate of Deposit contract, respectively. The next two columns represent the basis, that is, the difference between the cash price and the futures price or index for nearby delivery month contracts, for bonds and Certificates of Deposit, respectively. The last two columns show the spreads, that is, the difference between the futures price or index for nearby delivery month contracts and the futures price or index for first deferred delivery month contracts for bonds and Certificates of Deposit, respectively.

Figure 4:
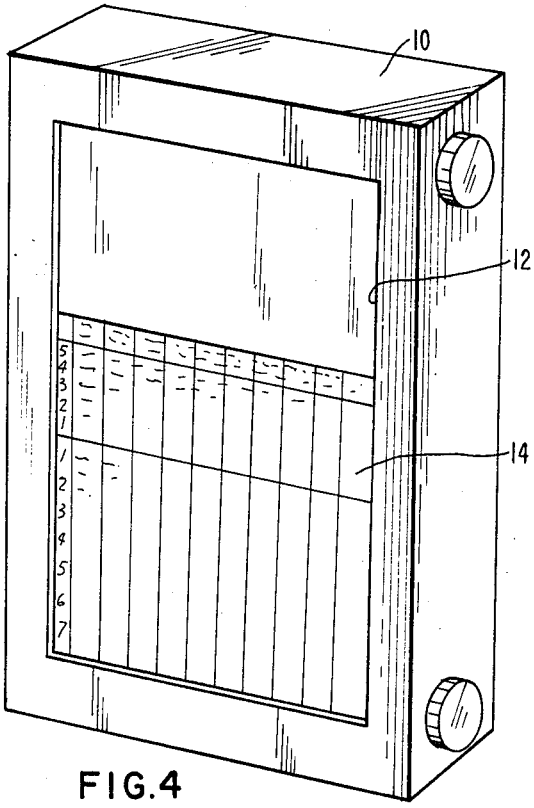
FIG. 4 is a perspective view of the holder of FIG. 1 with the chart display partially obscured to show seven playing days and five preceding trading days.
Figure 3:
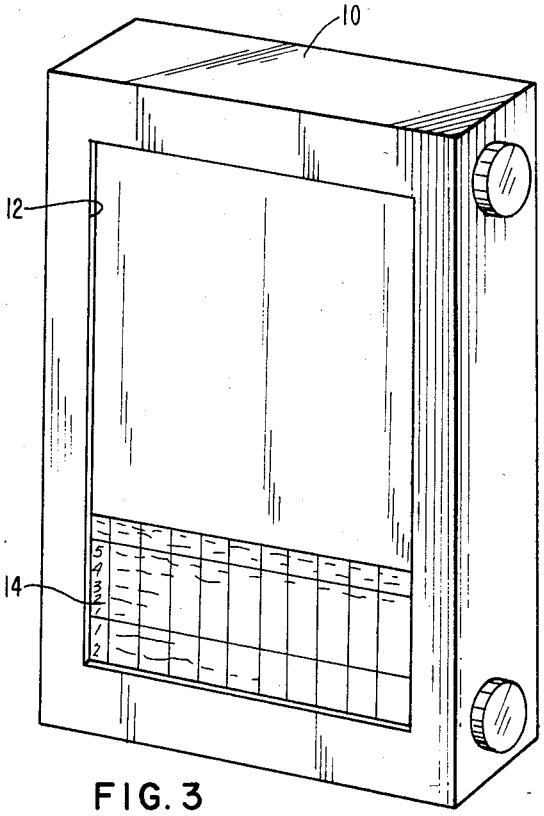
FIG. 3 is a perspective view of the holder of FIG. 1 with the chart display partially obscured to show only the first playing day and the preceding five trading days.

Since, under the rules of the game, the only information displayed in window 12 on any particular playing day is that information relating only to that playing day plus all of the preceding playing days and trading days prior to the start of play, the appearance of the device 10 as of playing day No. 2 is shown in FIG. 3. Similarly, the appearance of the device 10 as of playing day No. 7, for example, is shown in FIG. 4.

Figure 5:
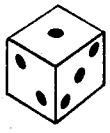
FIG. 5 is a perspective view of a die.

It will be distinctly understood that while particular information is depicted on the chart shown above in the drawings, this particular set of data is illustrated for exemplary purposes only. The game apparatus includes a plurality of such charts, each with different information, either provided on a continuous roll whereby only the chart used in a particular game is displayed, or provided on separate replaceable rolls or the equivalent. In the preferred embodiment, there are six separate such rolls, numbered, respectively, from 1 through 6. At the start of each game, the players throw a die to determine which of the six charts will be used for that game. Thus, if the die, as shown in FIG. 5, shows a one after being thrown, chart No. 1 would be used. Other means for choosing which particular chart will be used in a particular game may be used. Such means could include any means for choosing a number by chance such as the cut of a deck of playing cards, the spin of a pointer on a numbered wheel, or the like. Similarly, the sequence of trading turns for each of the players may be assigned at random or may be decided by chance through the throw of a die or dice, or any other equivalent means.

FIG. 6 is a form showing the trader's original portfolio. Each of the traders or players is given a starting portfolio, as will be discussed more fully hereinbelow, with that portfolio being represented by this form. In the form depicted in FIG. 6, there is shown assets consisting of three Treasury Bonds having a face value of $100,000 and cash in an amount to bring the total assets to $3,000,000. Each player is also given an order to emit a hedged 90-day Certificate of Deposit for $1,000,000 during the first eight days of the game. Each player's net worth at the beginning of the game is $3,000,000.

FIG. 7 shows a portfolio net worth form which is, in effect, a balance sheet. On any particular playing day, each player will enter the required information on this form and compute his net worth at the end of that trading day.

A play Treasury Bond is depicted in FIG. 8, the bond having a face value of $100,000 and a particular coupon rate, in this case, 13%. The trading price is entered when a trade is made.

Similarly, a 90-day Certificate of Deposit is shown in FIG. 9, the CD having a face amount of $1,000,000. The emission date and yield rate are entered at the appropriate time.

FIGS. 10A and 10B are cash disbursement and cash receipt vouchers which are used, in the preferred embodiment, in place of play money. When needed, the names of the traders involved, date, value, and purpose are entered on the vouchers. While play money could be used instead of these vouchers, it is obviously easier to use vouchers.

FIG. 11 is a calculation sheet to show the results of a hedge operation in the cash market and futures market.

FIG. 12 is a calculation sheet for spreading or pure speculation futures showing the nearby and deferred legs.

FIG. 13A and 13B are credit slips showing extension of credit and receipt of credit, respectively.

FIG. 14 depicts a prize slip for a perfect or overhedge. This will be discussed more fully hereinbelow.

Game Rules

In order to properly understand and play the game, a knowledge of the following rules is necessary:

1. Operations allowed.

The players, or bank traders, may involve themselves in the following futures operations:

a. Hedging in futures.

b. Intra-spreading in 90-day CD or T-Bond futures contracts.

c. Pure speculation in 90-day CD or T-Bond futures.

2. Portfolio components.

A portfolio common to all players consisting of long maturity T-Bonds and cash for a total value of $3,000,000 is supplied to each player. There is an order to emit a 1,000,000, 90-day CD during the first eight trading days under hedging with the CD futures contract. The portfolio form is selected at random from three possible forms. All random selections and assignments in the rules are done on the throw of a die. The difference in the forms is the number of bonds issued to the player. The form shown in FIG. 6 includes three bonds. The other variations on this form include four and five bonds, respectively.

3. Purpose of operations.

The operations performed by the players have as an aim to try to increase the portfolio net worth through the trading of T-Bonds, intra-spreading and pure speculation in 90-day CD and T-Bond futures contracts and profit from investment of increased cash account from emission of a 90-day CD. Cash trades are to be protected through the mechanism of hedging in financial futures.

4. Price and rate daily market observations.

There are supplied the lists of price, rate, basis, and spreads in various different sets, each set printed on a roll to be viewed on the market observations display.

On each roll there appear the observations that correspond to the five business market days preceding the game, followed by those for trading days 1 to 20. The bank traders always have in view the market observations for the preceding five business days and up to the current trading day of the game. No player may view the market observations following the current trading day.

a. Cash T-Bond prices.

b. Cash CD rates.

c. Futures nearby delivery T-Bond contract prices.

d. Futures first deferred T-Bond contract prices.

e. Futures nearby delivery CD contract price indices.

f. Futures first deferred CD contract price indices.

g. Basis to nearby delivery contract prices for T-Bonds and CD's respectively.

h. Futures spreads between nearby and first deferred prices for T-Bond and CD contracts, respectively.

These lists cover a period of four successive trading weeks, or 20 trading days. The traders choose at random, on the throw of a die, one roll from those available for each game event.

The roll selected holds throughout the game. The prices, or rates, are fixed for each day, thus, the game markets are restricted to a single price quote which represents a settlement price for the day.

5. Number of traders.

The number of bank traders should be two to four.

6. Number of trading days.

The number of trading days is 20.

7. Exclusion of delivery procedures.

Onset of delivery procedures on nearby futures delivery month for CD or T-Bond contracts are assumed posterior to the 20 trading days of the game.

8. Sequence of trading turns.

A sequence of trading turns holds for the bank traders throughout the trading days of a game event. These are assigned at random.

9. The trading day.

A trading day starts with trader 1 operations and finishes when the trader with the last trading turn completes his operations. Trading days follow one another as the ordered traders complete cycles of trading day operations.

10. Trading day market observations.

At the start of a trading day the market observations for the day are brought into view on the market display.

11. Trader's extent of activity on his trading day turn.

On any trading day each player may participate in opening or closing cash or futures positions. He must not open more than one and close more than one cash position under hedging, nor engage in more than one cash unhedged trade. He must not open or close more than three of both types futures positions.

12. Supervision of game.

The group of bank traders supervises all actions in the game. Each bank trader's portfolio outcome must be approved by at least one other bank trader.

13. Record forms.

All money transfers from one trader to another, prizes, as well as hedging, spreading, and pure speculation operations are recorded in the proper forms. These are used when preparing a portfolio net worth outcome.

14. Cash trade closed.

When a cash trade is closed, payment is made by buyer to seller.

15. Futures position opened or closed.

When a futures leg is opened, no payment is made (buyer to seller) between trader and counter trader; however, on offsetting the futures leg, the gain of one trader is paid by the other trader (his loss). This is so on offsetting any futures leg, be it that of hedging or pure speculation, or in each of both futures legs in the spreading operation.

16. Answering offers or bids from a trader.

As the trader in turn makes his offers and/or bids, the other traders answer to these voluntarily or by assignment according to rules 20, 24 and 23.

17. Assurance of liquidity.

Before performing a cash purchase, either hedged or not, the trader must assure himself that his cash balance is sufficient; otherwise, he must sell assets, or give them as part or total payment if such is accepted by the seller.

18. Bank trader disqualified.

If a trader has no means of paying in full a trading debt, his net worth being lower than the debt amount, he is disqualified as a trader and must hand over to his creditor his portfolio, i.e., his net worth. The balance of the debt is credited to the creditor's cash account.

19. Counter trades to hedging operation.

When a trader enacts a hedging operation, another trader may take the counter trades in both cash and futures legs of the hedge. These counter trades constitute a hedged operation (counter hedge) to the opening counter cash position, thus, the counter hedge trader complies with rule 27.

Also, in a hedging operation, the cash counter offset trade and both futures counter trades may be taken by different counter traders.

In relation to the cash counter trade of a hedge offset position, the acceptance of the same by a counter trader may be deferred to offset time of the hedge, at the then current and thus unhedged price to the counter trader. But, if taken by the counter trader upon being announced (onset) by the trader in turn, then the counter trader opens his hedge at the moment by taking the counter hedge.

20. Answering the trade of one bond instrument at current price.

In case a cash counter trade for one bond instrument at the then current price is not taken voluntarily by any trader, then the counter trade is assigned at random among those traders who have the necessary uncommitted cash to buy, or among all traders who hold uncommitted bonds in case of a sale (overrules rule 11).

If the trader wishes to sell or buy more than one bond, he depends on the willingness of the other traders to buy from or sell to him.

21. Counter trades to spreading in futures operation.

When a trader opens a spreading operation, either one trader takes the counter trades in both futures legs (counter spread) or two traders take each the counter trades on one futures leg.

22. Counter trades to pure speculative futures operation.

When a trader opens a pure speculative futures operation, both counter trades must be taken by a counter trader.

23. Cash closing counter trade to 90-day CD emission.

If the cash counter trade to the sale of a 90-day CD emission is not taken voluntarily by any trader, it is assigned at random among those traders that have not bought a CD emission or among those that have bought just one.

24. Assignment of counter trades.

If the necessary counter trades to cash or futures legs of a hedge, spread, or speculative position of a trader are not taken voluntarily by the other traders then the necessary counter trades are assigned at random (overrules rule 11).

25. Credit among game bank traders.

Credit may be extended by seller to buyer, but buyer must have net worth in excess of debt until payment is made, otherwise rule 18 is applied.

26. Emission of a 90-day CD.

Each player emits a 90-day CD under a hedge and pays interest on the same for the remaining days of the game. Payment of interest and return of principal to be effected at end of the game.

27. Life of hedges and prize for perfect or overhedge.

All future cash trade decisions taken on a given day must be closed the next trading day and must be hedged. Any trader who performs a perfect or an overhedge receives a prize of $1000. Hence, on a given day, the decision on a future cash trade is taken as well as the opening trade of the corresponding futures hedge operation. Next day the cash operation is closed and the futures position is offset. Thus, the life of any hedge in the game is one day.

28. Life of speculative furtures positions.

All spreading and pure speculative operations opened on a given day are offset the next trading day. Thus, the life of any speculative position in the game is one day.

29. Portfolio and net worth outcome.

Each bank trader fills in price of T-Bonds, total value of T-Bonds, and .cash value on the trader's original portfolio form selected for the game event at the start of the first B.D. (business day). Henceforth, he fills a portfolio net worth form at the close of each trading day.

30. Winner of the game.

The winner of the game is that bank trader who has the highest net worth portfolio at the end of the game.

EXAMPLE

With the principles of the futures financial market in mind, and with the rules of the game in mind, an example of part of a typical game is now given. This example is keyed to the chart of the following table:

PRICE-RATE SPREAD TABLE

| | CASH MARKETS | | FUTURES MARKETS-CONTRACTS | | | | FUTURES SPREADS | |
|---|---|---|---|---|---|---|---|---|
| | C TBonds price | C CD's rate | F1 TBonds price | F2 TBonds price | F1 CD's pr. index | F2 CD's pr. index | S TBonds F1–F2 | S CD's F1–F2 |
| | 65-08 | 13.00 | | | | | | |
| 1. | 65-00 | 13.25 | 65-08 | 65-00 | 87.90 | 87.85 | 00-08 | 0.05 |
| 2. | 64-16 | 13.00 | 64-24 | 64-10 | 87.90 | 87.80 | 00-14 | 0.10 |
| 3. | 64-20 | 13.00 | 64-30 | 64-05 | 88.00 | 87.85 | 00-25 | 0.05 |
| 4. | 64-30 | 13.50 | 65-05 | 64-12 | 87.40 | 87.22 | 00-25 | 0.18 |
| 5. | 65-00 | 13.50 | 65-08 | 64-12 | 87.35 | 87.20 | 00-28 | 0.15 |
| 6. | 65-04 | 14.00 | 65-10 | 64-18 | 87.30 | 87.11 | 00-24 | 0.19 |

Trader's Portfolio

On the first day of the game, each trader received a portfolio as follows. Prices or rates quoted are current for day 1 on the table.

A. Assets. Total $3,000,000
  1. T-Bonds (13%). Four. Face value $100,00 ea. cur. price 65-00.
  Value $260,000
  2. Cash.
  Value $2,740,000
B. Liability.
  1. Order to emit a 90-day CD for $1,000,000 within the first eight days of the game. Current rate 13.25%.
Net worth $3,000,000

Playing (Business) Day 1

Trader I decides to offer one T-Bond for sale next day since bonds seem to be declining in price. In order to hedge this operation, as required by the rules of the game, he goes short (sells) one T-Bond contract.

Day 1 cash T-Bond price is 65-00 and the T-Bond contract price is 65-08 for a basis value of -(00-08). He will offset next day his position in futures upon selling the cash bond.

Trader II agrees to take both futures counter trades, thus, deciding on a speculative operation in T-Bond futures Trader III decides to take the cash counter trade and thus buy the cash T-Bond next day. Trader III must open a corresponding futures hedge position.

There is no change in values in Trader I portfolio at the end of business day 1.

Portfolio net worth $3,000,000.

Business Day 2

Trader I offsets his T-Bond hedge in futures by going long (buy) one T-Bond contract at the current price of 64-24, and sells his cash T-Bond to Trader III at 64-16.

Hedge diagram

| | Cash Market | Futures Mark | Basis |
|---|---|---|---|
| Day 1 | Decision to sell one T-Bond Price 65-00 | Sells one T-Bond contract Price 65-08 | −(00-08) |
| Day 2 | Sells cash T-Bond Price 64-16 Price 64-24 Cash loss (.005)($100,000) = $500 | Buys one T-Bond contract −(00-08) Futures gain 16/32 in price change (16)($31.25) = $500 | |

Hedge efficiency = 100%

Hedge is a short, direct, perfect hedge, plus $1000 from hedging prize.

Locked T-Bond price = 65-00.

Trader II pays Trader I the $500 he lost and which is Trader I's futures gain.

Trader III pays Trader I at the current day 2 cash T-Bond price of 64-16 the amount of $64,500.

Notice that Trader I receives a total of $65,000 which corresponds to the locked T-Bond price of 65-00 current on day 1.

| Portfolio Outcome. | | |
|---|---|---|
| Assets. | 1. Three T-Bonds (13%) at current 64-16 | $193,500 |
| | 2. Cash account | |
| | Day 1 | 2,740,000 |
| | 1 T-Bond sale | 65,000 |
| | Total cash | 2,805,000 |
| Liability | | |
| | 1. Order to emit a 90-day CD for $1,000,000 within the first eight days of the game. Current rate 13%. | |
| Portfolio net worth | | $2,998,500 |
| Plus $1,000 from hedging prize | | |

Business Day 3

Trader I feels that CD rates are about to increase and decides to emit the $1,000,000 90-day CD next day. Hence, he opens a short position in futures with a nearby CD contract.

The CD cash rate is 13% and for the nearby CD contract it is 12% for a price index of 88.00.

Trader IV decides to take the opposite counter trades in both cash and futures, i.e., but the emitted CD and take a long position (buy) in futures to be offset when buying the CD next day, which constitutes a counter hedge.

| Portfolio outcome | |
|---|---|
| A. Assets | |
| 1. Three T-Bonds (13%) at current 64-20 | $193,875 |
| 2. Cash account | |
| Day 2 | 2,805,000 |
| Total cash | 2,805,000 |
| B. Liability | |
| 1. Closing next day 4 | |
| Portfolio net worth | 2,998,875 |
| Plus $1000 from day 2 hedging prize. | |

Business Day 4

Trader I emits the $1,000,000 90-day CD at a cash rate of 13.5% and offsets his CD contract at a price index of 87.40.

Hedge Diagram

| | Cash Market | Futures Market | Basis |
|---|---|---|---|
| Day 3 | Decision to issue a $1,000,000 90-day CD on day 4 Rate 13% | Sells one 90-day CD nearby futures contract Current Rate 12% Price index 88.00 | 1.00 |
| Day 4 | 90-day CD is issued Rate 13.5% | Buys one 90-day CD nearby futures contract Current Rate 12.6% Price index 87.40 | 0.90 |
| | Cash increased cost $1,000,000 (.005)¼ = $1250 | Futures gain 60 basis points (60) $25 = $1500 | |

Hedge efficiency = 120%

Hedge is a short direct overhedge. Plus $2000 from day 2, 4 hedging prizes.

Locked emission rate is 12.9% (gain in futures offsets change in cash rate by 120%. 13.5−1.20(.50) = 12.9%).

Trader IV hands over to Trader I a cash total of $1,000,00 for the CD and $1500 from his loss in futures. Notice that, however, Trader IV is buying a higher yielding CD (13.5%) than the yield on day 3 (13%).

| Portfolio outcome | |
|---|---|
| A. Assets | |
| 1. Three T-Bonds 13% at current 64-30 | $194,812.50 |
| 2. Cash account | |
| Day 3 | 2,805,000.00 |
| 90-Day CD emission | 1,000,000.00 |
| Gain in futures | 1,500.00 |
| Total cash | 3,806,500.00 |
| B. Liability | |
| 1. 90-day CD for 17 days at 13.5% ($1,000,000+[.135($1,000,000)¼]17/90) | 1,006,375.00 |
| Portfolio net worth | 2,994,937.50 |
| Plus $2000 from day 2, 4 hedging prizes. | |

Business Day 5

T-Bonds have been recovering in price. Trader I buys on day 5 four T-Bonds offered to him at current 65-00. He does not open a hedge being an offer for immediate delivery from Trader III, that is, the latter trader is closing on day 5 the cash component of his hedged sale of four T-Bonds for which he did not make a commitment with a counter trader on day 4.

Also, he believes that the T-Bond contract price spread between the nearby and first deferred contacts will narrow by next day. Operating according to spreading theory, Trader I opens a long position in five deferred bond contracts being these at a discount to the nearby, and a short position in five nearby bond contracts. According to theory, on offsetting next business day with a narrowed spread, a net gain is accrued from the two spread components (legs) provided the price trends stay correlated.

The futures counter opening trades in both spread legs are taken by Trader II, who thus engages in the counter spreading operation.

| Portfolio outcome | |
|---|---|
| A. Assets. | |
| 1. Seven T-Bonds 13% at current 65-00 price | $455,000.00 |
| 2. Cash account | |
| Day 4 | 3,806,500.00 |
| (-)Four T-Bonds purchase | 260,000.00 |
| Total cash | 3,546,500.00 |
| B. Liability. | |
| Day 4 | 1,006,375.00 |
| Portfolio net worth | 2,995,125.00 |
| Plus $2000 from day 2, 4 hedging prizes. | |

Business Day 6

Trader I offsets both legs of his intra-spread with T-Bond contracts in the nearby and first deferred months with good results since the pribe spread narrowed.

T-Bond Intra-Spread Diagram

| | Nearby Month | 1st Deferred Month | Spread |
|---|---|---|---|
| Day 5 | Sells five T-Bond contracts Price 65-08 | Buys five T-Bond contracts Price 64-12 | 00-28 |
| Day 6 | Buys five T-Bond contracts Price 65-10 Loss-2/32 per contract (2)31.25(5) = $312.50 | Sells five T-Bond contracts Price 64-18 Gain-6/32 per contract (6)31.25(5) = $937.50 | 00-24 |
| Net gain = $625.00 | | | |

Trader I pays $312.50 to counter Trader II from the nearby month operation and Trader I receives, from Trader II, $937.50 from the first deferred month operation gain.

| Portfolio outcome | |
|---|---|
| A. Assets | |
| 1. Seven T-Bonds 13% at current 65-04 | $455,875.00 |
| 2. Cash account | |
| Day 5 | 3,546,500.00 |
| Net gain from intra-spread | 625.00 |
| Total cash | 3,547,125.00 |
| B. Liability | |
| Day 4. CD emission | 1,006,375.00 |
| Portfolio net worth | 2,996,625.00 |
| Plus $2000 from day 2, 4 hedging prizes. | |

Conclusion

As matters stand at the end of the sixth business day (day 5), Trader I has accrued during the last three trading days (day 4–day 6), and after emitting the 90-day CD on day 4, a net gain of $2687.50. He has now about $3.5 million in cash to operate in pure speculation and intra-spreads in T-Bond an CD futures contracts and to continue trading T-Bonds.

Notice from the column on futures T-Bond spreads between nearby and first deferred months prices, that one may consider the bond price spread is too narrow having reached a peak at 28/32. He could gamble on this for gains by simultaneously buying the lower and selling the higher priced contract in the two markets and offsetting as the spread narrows.

Notice also that it looks as if the price spread for CD contracts seems to be peaking upwards and a CD's intra-spread under a widening spread expectation is probably in order. This should be opened on the next fall of the price spread so that upon the spread widening, the gain is maximized. Here we would buy the higher priced and simultaneously sell the lower priced month offsetting likewise as the spread widens.

There is also a possibility for pure speculation in CD contracts since in both nearby and first deferred futures months we notice that CD futures are in down markets. The fall in index price from day 1 to day 6 corresponds to 60 basis points in the nearby and 74 basis points in the first deferred month for a $1500 and $1850 change in value per contract, respectively. Since pure speculators, the wise ones, hold to the principle of not going against the market, we could open speculation by selling (going short) CD's now so as to benefit from a possible continued fall and a gain from offsetting (buying the contracts) at a lower price, but watching these markets so that when they change to an up market (bear to bull market) we would be advised again to open pure speculation by buying (going long) and benefiting from offsetting (sell) at a higher price. A pure speculation operation is done in one futures market.

Our considerations, or Trader I's considerations, may fall short of materializing in some of these projected operations simply because nobody knows how to forecast interest rates with a sound assurance. However, this helps in finding counter traders to our trades and our losses turn to be their gains.

It should be apparent from the foregoing detailed description that the objects set forth hereinabove have been successfully achieved. Moreover, while there is shown and described a present preferred embodiment of the invention, it is to be distinctly understood that the invention is not limited thereto, but may be otherwise variously embodied and practiced within the scope of the following claims. Accordingly,

What is claimed is:

1. A game for simulating financial futures market transactions to be played by at least two players, comprising:

(A) a chart display including fixed data representing cash market prices, futures market prices, basis, and spread of both long- and short-term financial futures instruments contracts on a daily basis, for a predetermined number of playing days plus a predetermined number of trading days prior to the start of the playing days;

(B) means for displaying the current playing day plus all the trading day and playing days prior to the current playing day, while obscuring all future playing days on said chart; said displaying means comprising a holder with a display window and means for moving said chart display relative to said window, said moving means comprising a pair of rollers to which the ends of said chart are affixed, whereby said chart moves past said window when one of said rollers is turned, said window being of a size that the full chart display will appear therein on the last of said predetermined number of playing days;

(C) means for effecting an exchange of cash;

(D) play Treasury Bonds having a given face value and coupon rate;

(E) play orders to emit a 90-day Certificate of Deposit for a given face amount and current rate in a given number of playing days;

(F) record forms for each player to record his portfolio net worth on a given day, his hedging, spreading and pure speculation operations; and (G) means for awarding prizes to players.

2. The game as defined in claim 1, wherein said data are in columnar form arranged longitudinally on said chart display and said chart display is moved longitudinally relative to said window.

3. The game as defined in claim 1, wherein a plurality of said chart displays are provided on a single web.

4. The game as defined in claim 1, further comprising a plurality of separate chart displays, wherein a single one of said separate chart displays is chosen to be mounted in said display means for a particular game.

5. A game for simulating financial futures market transactions to be played by at least two players, comprising:

(A) a chart display including data representing cash market prices, futures market prices, basis, and spread of both long- and short-term instruments, for twenty playing days plus five trading days prior to the start of the playing days;

(B) means for displaying the current playing day plus all the trading days and playing days prior to the current playing day, while obscuring all future playing days on said chart, said displaying means comprising a holder with a display window and means for moving said chart display relative to said window, said moving means comprising a pair of rollers to which the ends of said chart are affixed, whereby said chart moves past said window when one of said rollers is turned, said window being of a size that the full chart display will appear therein on the twentieth playing day;

(C) means for effecting an exchange of cash;

(D) paly Treasury Bond having a given face value and coupon rate;

(E) play orders to emit a 90-day Certificate of Deposite for a given face amount and current rate in a given number of playing days;

(F) record forms for each player to record his portfolio net worth on a given day, his hedging, spreading and pure speculation operations; and (G) means for awarding prizes to players.

6. The game as defined in claim 5, wherein said data are in columnar form arranged longitudinally on said chart display and said chart display is moved longitudinally relative to said window.

7. The game as defined in claim 5, wherein a plurality of said chart displays are provided on a single web.

8. The game as defined in claim 5, further comprising a plurality of separate chart displays, wherein a single one of said separate chart display is chosen to be mounted in said display means for a particular game.

* * * * *